US007959250B2

(12) United States Patent
Kim

(10) Patent No.: US 7,959,250 B2
(45) Date of Patent: Jun. 14, 2011

(54) METHOD AND APPARATUS TO DETECT PRINT LOCATION ERROR USING PRINT DOTS

(75) Inventor: Byung-Hun Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 1019 days.

(21) Appl. No.: 11/770,972

(22) Filed: Jun. 29, 2007

(65) Prior Publication Data

US 2008/0137915 A1 Jun. 12, 2008

(30) Foreign Application Priority Data

Dec. 6, 2006 (KR) ..... 10-2006-0123381

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,736,478 B2 * 5/2004 Franzke et al. ..... 347/19

* cited by examiner

*Primary Examiner* — Julian D Huffman
(74) *Attorney, Agent, or Firm* — Stanzione & Kim, LLP

(57) ABSTRACT

A method and apparatus to detect a print location error using print dots. The method includes transforming values of pixels of a first image into frequency domains, where a plurality of print dots are arranged at predetermined intervals in the first image; transforming values of pixels of a second image, where the second image is obtained by actually printing the first image using an inkjet head; detecting 2D (2-dimensional) cross power spectral densities of the frequency-domain values of the first and second images; calculating 2D cross correlation values by transforming the 2D cross power spectral densities into time domain; and detecting error coordinates representing the distances between the print dots of the second image and the first image from the time-domain cross correlation values. Accordingly, it is possible to perform coordinates compensation by detecting errors between ideal print dots and actually printed print dots so that an image sensor can move exactly to print dots in order to sense print dots sprayed from an inkjet head that is newly exchanged in an image forming apparatus.

15 Claims, 4 Drawing Sheets

METHOD AND APPARATUS TO DETECT PRINT LOCATION ERROR USING PRINT DOTS

CROSS-REFERENCE TO RELATED APPLICATIONS

This application claims the benefit of Korean Patent Application No. 10-2006-0123381, filed on Dec. 6, 2006, in the Korean Intellectual Property Office, the disclosure of which is incorporated herein in its entirety by reference.

BACKGROUND OF THE INVENTION

1. Field of the Invention

The present general inventive concept relates to an inkjet printer, and more particularly, to a method and apparatus to detect a print location error using print dots in order to allow an image sensor to precisely detect the locations of print dots even if inkjet heads are exchanged in an inkjet printer to manufacture color filters for use in a display device.

2. Description of the Related Art

Inkjet printers, which are frequently used in offices and homes, are non-impact printers that perform printing by finely spraying ink drops. In general, inkjet printers are used to print outputs on a print medium in an office or home, but are nowadays also used to manufacture color filters for use in a display device, such as a liquid crystal display (LCD). For example, it is possible to manufacture R, G and B color filters by respectively spraying R, G and B colors onto films for color filters.

Since the frequency of use of inkjet printers when they are used to manufacture color filters is greater than when they are used in offices or homes, inkjet heads of a inkjet printer must be periodically exchanged. However, periodic exchange of inkjet heads causes head alignment errors that change a transfer position of an image sensor that senses print dots being sprayed from an inkjet head. Therefore, it is inevitable that an error in the transfer position of the image sensor is caused by an exchange of inkjet heads.

SUMMARY OF THE INVENTION

The present general inventive concept provides a method and apparatus to precisely detect a print location error by using print dots in order to allow an image sensor to precisely detect the locations of print dots even if inkjet heads are exchanged in an inkjet printer.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of detecting a print location error using print dots, the method including: transforming values of pixels of a first image into frequency domains, where a plurality of print dots are arranged at predetermined intervals in the first image; transforming values of pixels of a second image, where the second image is obtained by actually printing the first image using an inkjet head, into frequency domains; detecting 2D (2-dimensional) cross power spectral densities of the frequency-domain values of the first and second images; calculating 2D cross correlation values by transforming the 2D cross power spectral densities into time domain; and detecting error coordinates representing the distances between the print dots of the second image and the first image from the time-domain cross correlation values.

The foregoing and/or other aspects and utilities of the present general inventive concept may also be achieved by providing an apparatus to detect a print location error using print dots, the apparatus including: a first transformation unit to transform values of pixels of a first image into frequency domains, where a plurality of print dots are arranged at predetermined intervals in the first image; a second transformation unit to transform values of pixels of a second image into frequency domains, where the second image is obtained by actually printing the first image using an inkjet head; a cross power spectral density detector to detect 2D (2-dimensional) cross power spectral densities of the frequency-domain values of the first and second images; a third transformation unit to calculate 2D cross correlation values by transforming the 2D cross power spectral densities into time domains; and an error coordinates detector to detect error coordinates representing the distances between the print dots of the second image and the first image from the time-domain cross correlation values.

The foregoing and/or other aspects and utilities of the present general inventive concept may also be achieved by providing a method of detecting a print location error using print dots, the method including transforming values of pixels of a first image into frequency domains, where a plurality of print dots are arranged at predetermined intervals in the first image, transforming values of pixels of a second image, where the second image is obtained by actually printing the first image using an inkjet head, into frequency domains, obtaining the maximum of cross correlation values from the frequency-domain values of the first and second images, and detecting error coordinates representing the distances between the print dots of the second image and the first image from the time-domain cross correlation values.

The foregoing and/or other aspects and utilities of the present general inventive concept may also be achieved by providing an apparatus to detect a print location error using print dots, the apparatus including a first transformation unit to transform values of pixels of a first image into frequency domains, where a plurality of print dots are arranged at predetermined intervals in the first image, a second transformation unit to transform values of pixels of a second image into frequency domains, where the second image is obtained by actually printing the first image using an inkjet head, a third transformation unit to obtain cross correlation values from the frequency-domain values of the first and second images, and an error coordinates detector to detect error coordinates representing the distances between the print dots of the second image and the first image from the time-domain cross correlation values.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
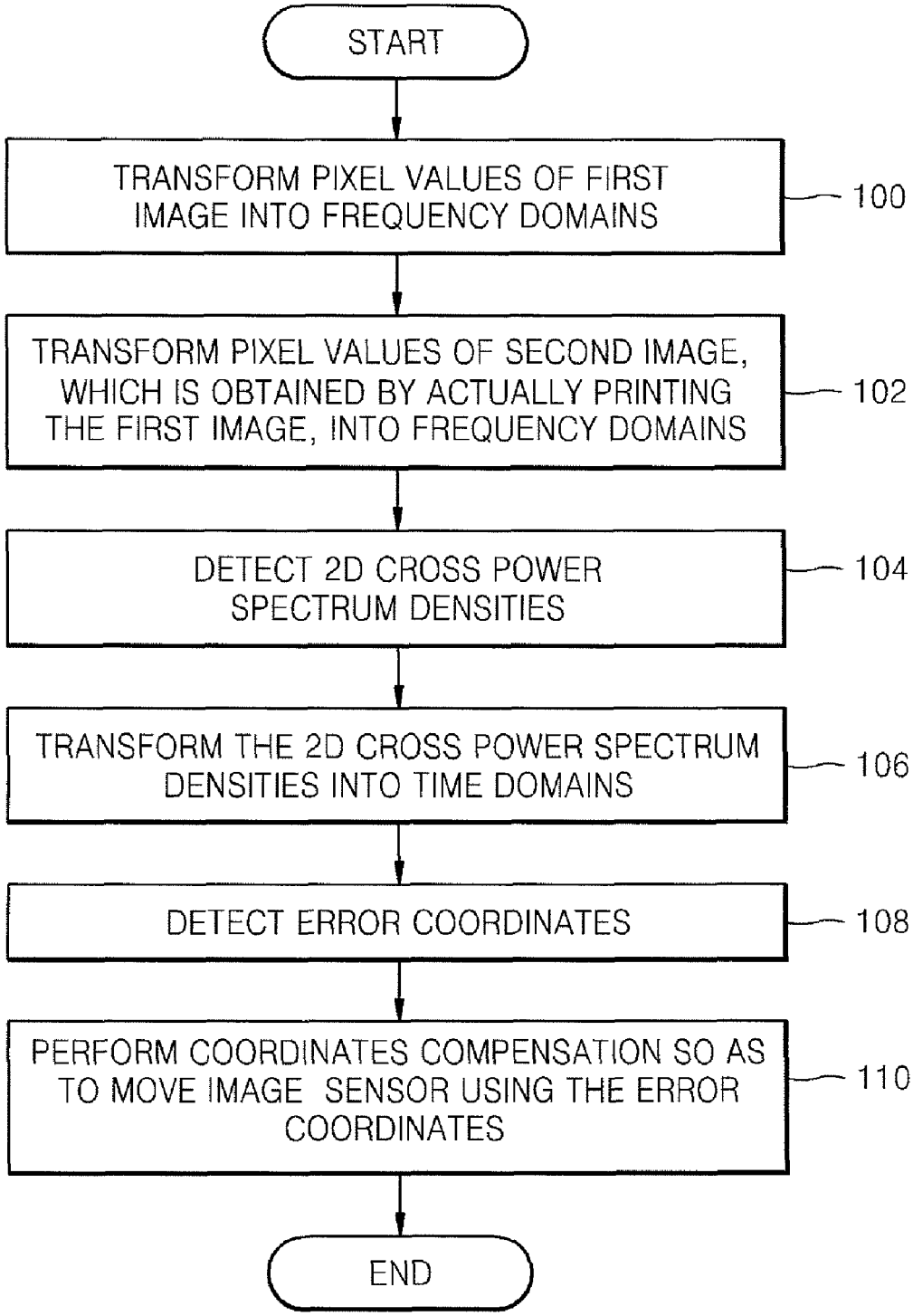
FIG. 1 is a flowchart illustrating a method of detecting a print error location using print dots, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a flowchart illustrating a method of detecting a print error location using print dots, according to an embodiment of the present general inventive concept.

First, the values of pixels of a first image in which a plurality of print dots are arranged at predetermined intervals are transformed into frequency domains (operation 100).

Figure 2A:
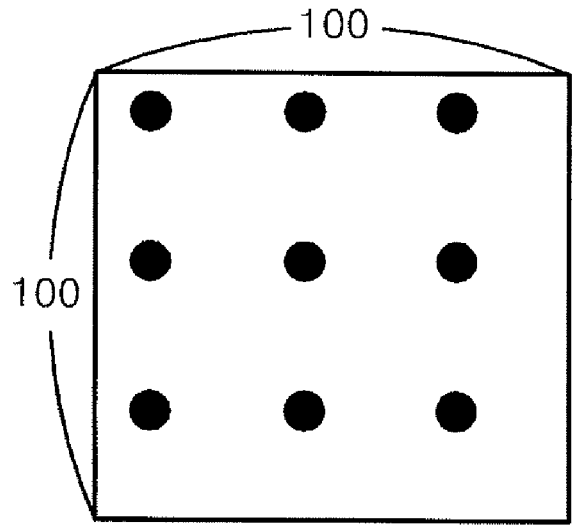
FIG. 2 illustrates a first image and a second image according to an embodiment of the present general inventive concept.

FIG. 2 illustrates a first image and a second image according to an embodiment of the present general inventive concept. Referring to FIG. 2A, an image in which 9 black print dots are arranged at predetermined intervals is set as a first image. The first image consists of a predetermined number of pixels, e.g., 100×100 pixels. If the values of the pixels are grouped into two levels in a two bit image, the values of the pixels at the locations of the black print dots are set to "0" and the values of the white (other) pixels are set to "1." If the values of the pixels are grouped into 256 levels in an eight bit image, the values of the pixels on the black print dots are set to "0" and the values of the white (other) pixels are set to "255." In the same way, it is possible to obtain 10000 frequency-domain values by transforming the groups of the pixel values of the first image into frequency domains.

In particular, in the current embodiment, the pixel values of the first image are transformed into frequency domains by using Fast Fourier Transform, which is one of transformation modes. Fast Fourier Transform, which is a mode of transforming a time-domain function into a frequency-domain function, is an algorithm that increases the efficiency of calculation speed using the periodicity of a trigonometrical function of Discrete Fourier Transform. Fast Fourier Transform is a well-known technique, and thus, a detailed description thereof will be omitted.

Figure 2B:
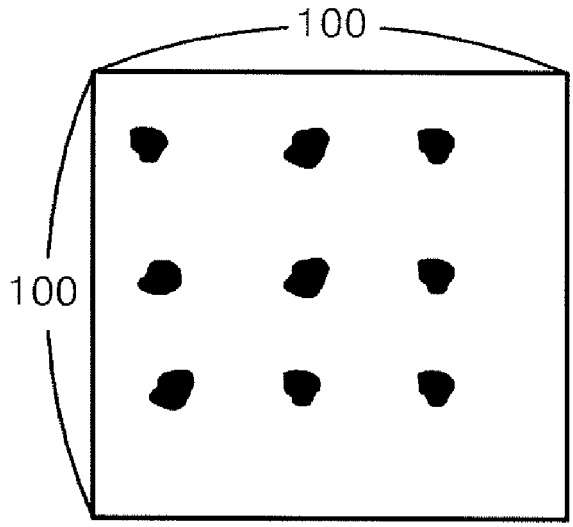

After operation 100, the values of pixels of a second image, which is obtained by printing the first image on a print medium using an ink head, are respectively transformed into frequency domains (operation 102). Print dots on the actually output second image have irregular shapes rather than round shapes and the distances between print dots are not the same, unlike on the first image. Such phenomena often occur when using a printer that employs an inkjet head. As illustrated in FIG. 2B, the output second image consists of 100×100 pixels, for example, and the values of the pixels are read using an image sensor (not illustrated). If the read values of the pixels are grouped into 2 levels, the values of the pixels on black print dots are set to "0" and the values of the other pixels are set to "1." If the pixel values are grouped into 256 levels, the values of the pixels on the black print dots are set to "0" and the values of the other pixels are set to "255." In the same way, it is possible to obtain 10000 frequency-domain values by transforming the groups of the pixel values of the second image into frequency domains.

In the current embodiment, the pixel values of the second image are transformed into a frequency domain, using Fast Fourier Transform.

After operation 102, a 2-dimensional (2D) cross power spectral density of each of the frequency-domain values of the first image and the second image is detected (operation 104). The 2D cross power spectral density is detected using the following equation:

$$P(u, v)=A(u, v)B^*(u, v) \quad (1),$$

wherein A(u, v) denotes the pixel values of the first image that are transformed into frequency domains, B*(u, v) denotes the conjugate complex numbers of the pixel values of the second image that are transformed into frequency domains, and P(u, v) denotes the 2D cross power spectral densities of the first and second images.

For example, if the value of a pixel (m, n) on the first image is a, the result of transforming a(m, n) into a frequency domain is A(u, v), the value of a pixel (m, n) on the second image is b, and the result of transforming b(m, n) into a frequency domain is B(u, v), then the 2D cross power spectral density of each of the first and second images with respect to the pixel (m, n) may be calculated by multiplying A(u, v) by the conjugate complex number of B(u, v) as expressed in Equation (1). In the current embodiment, errors between the print locations of the first and second images are detected using the 2D cross power spectral density function. The 2D cross power spectral density function is a well-known technique, and thus, a description thereof will be omitted.

After operation 104, a 2D cross correlation value is calculated by transforming each of the detected 2D cross power spectral densities into a time domain (operation 106). The time-domain pixel values are transformed into the frequency-domain values in operation 102 and the 2D cross power spectral densities calculated based on the frequency-domain values are also frequency-domain values. Thus, these frequency-domain values are transformed into time-values. In this case, each of the 2D cross power spectral densities is transformed into a time-domain value in order to obtain the 2D cross correlation values, using inverse Fast Fourier Transform.

Figure 3:
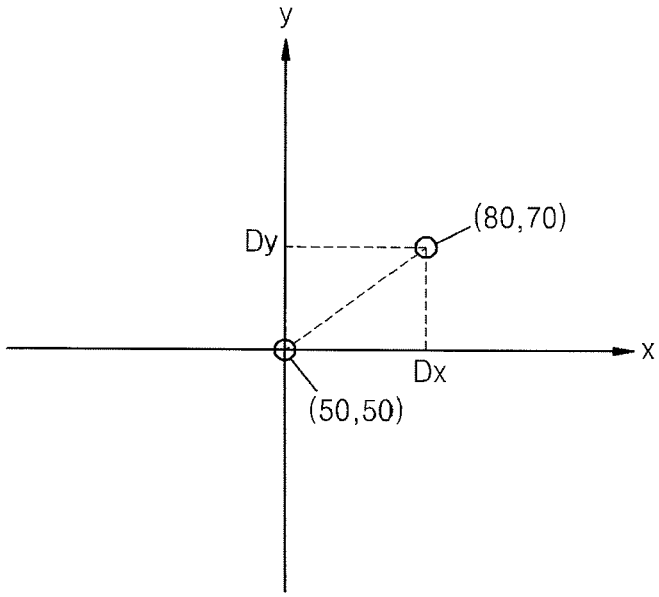
FIG. 3 illustrates error coordinates detected according to an embodiment of the present general inventive concept.

After operation 106, error coordinates representing the distances between the print dots of the second images and the print dots of first images, are detected from the cross correlation values which are the time-domain values (operation 108). Specifically, the error coordinates are detected by subtracting the coordinates of a central pixel of the first image from the coordinates of the pixel having a maximum value of the cross correlation values which are time-domain values. FIG. 3 illustrates an example of error coordinates detected according to an exemplary embodiment. For example, it is assumed that each of the first image and the second image consists of 100×100 pixels and the coordinates of a central pixel of each of the first and images are (50, 50). If the coordinates of the pixel having the maximum value of the cross correlation values (time-domain values) obtained in operation 106 are (80, 70), the error coordinates are obtained by subtracting the coordinates of the central pixel (50, 50) from the coordinates of the pixel (80, 70), that is, (Dx, Dy)=(80-50, 70-50)=(30, 20). (Dx, Dy) denotes the error coordinates representing the distances between the print dots on the second image and the corresponding print dots on the first image.

Figure 4:
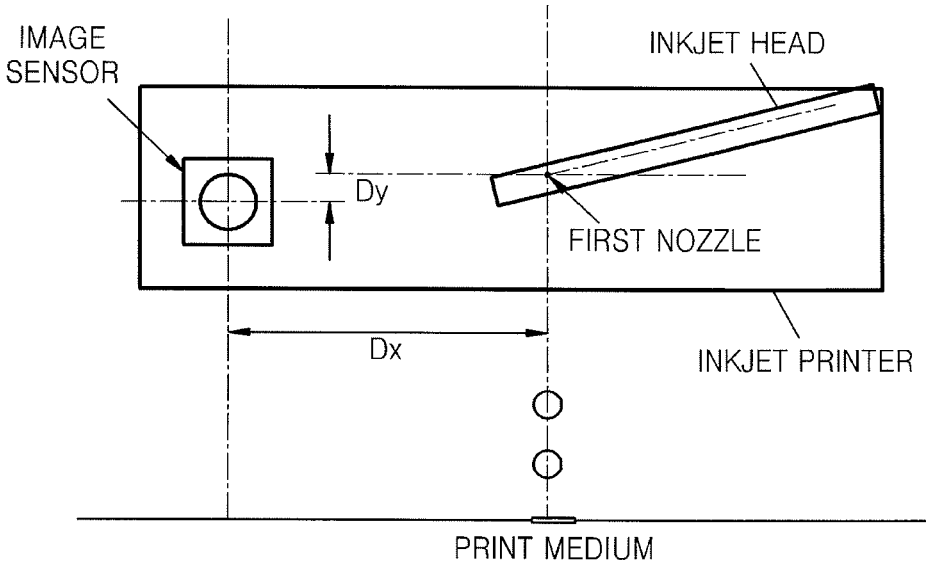
FIG. 4 is a diagram illustrating operation 108 of the method illustrated in FIG. 1, according to an embodiment of the present general inventive concept.

After operation 108, coordinates compensation is performed using the error coordinates in order to move the image sensor to the central point of each print dot sprayed from the inkjet head (operation 110). FIG. 4 is a diagram illustrating operation 108 of FIG. 1, according to an embodiment. As illustrated in FIG. 4, inkjet heads are periodically exchanged in an inkjet printer in order to respectively print colors on print media, such as a color filter. After the exchange of inkjet heads, the image sensor moves in order to sense print dots being sprayed from the inkjet head to be printed on a print medium (FIG. 4 illustrates print dots being sprayed from a first nozzle). In order to move the image sensor to the exact central point of each of the print dots, a compensation value for the movement of the image sensor is precisely obtained by subtracting the above error coordinates (Dx, Dy) from predetermined coordinates for the movement.

The operations of the above method of detecting a print location error using print dots according to an embodiment can be embodied as computer readable code/instructions/program.

The computer readable code/instructions/program can be executed in a general digital computer via a computer readable medium. The computer readable medium may be a magnetic storage medium (a ROM, a floppy disk, a hard disc, a magnetic tape, etc.), an optical storage medium (a CD-ROM, a DVD, etc.), and a carrier wave that transmits data via the Internet, for example. Also, the various embodiments herein can be embodied as a medium (or media) having recorded thereon computer readable code, and distributed among computer systems that are interconnected through a network. Function programs, code, and code segments to realize the various embodiments can be easily derived by programmers in the technical field to which the present invention pertains.

An apparatus to detect a print location error using print dots according to an embodiment will now be described with reference to the accompanying drawings.

Figure 5:
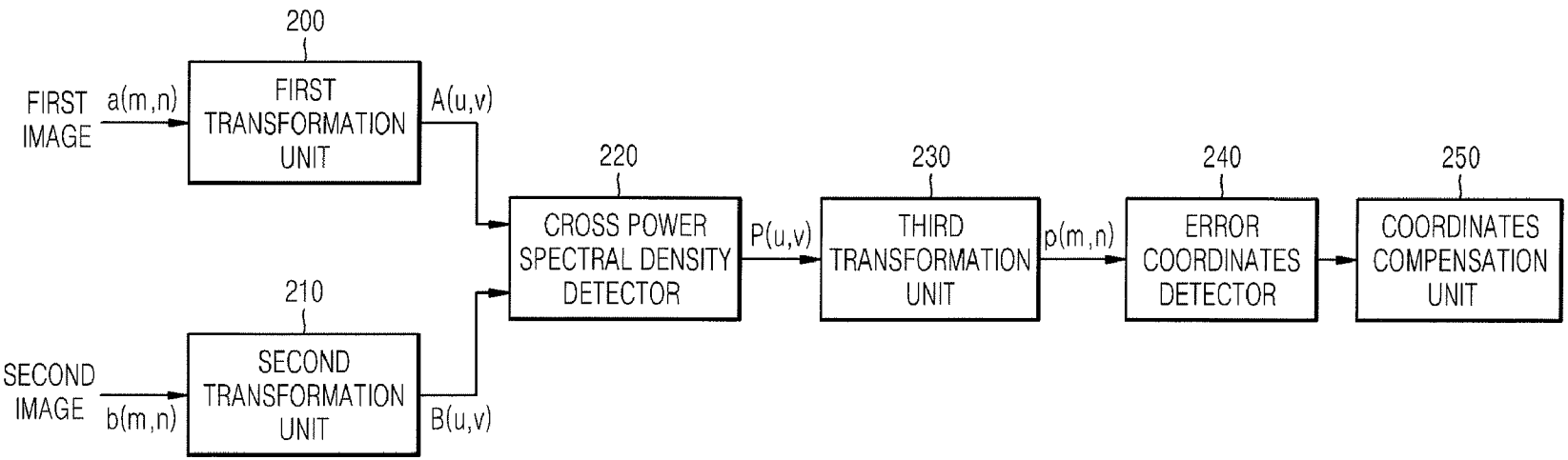
FIG. 5 is a block diagram of an apparatus that detects a print location error using print dots, according to an embodiment of the present general inventive concept.

FIG. 5 is a block diagram of an apparatus to detect a print location error using print dots, according to an embodiment. The apparatus includes a first transformation unit 200, a second transformation unit 210, a cross power spectral density detector 220, a third transformation unit 230, an error coordinates detector 240, and a coordinates compensation unit 250.

The first transformation unit 200 transforms pixel values of a first image in which a plurality of print dots are arranged at predetermined intervals into frequency domains, and outputs the transformed result to the cross power spectral density detector 220. The first transformation unit 200 transforms the pixel values of the first image into frequency domains by using Fast Fourier Transform. As illustrated in FIG. 5, the first transformation unit 200 transforms the value a of a pixel (m, n) on the first image into a frequency-domain value A(u, v). In the same way, the first transformation unit 200 transforms each pixel value of the first image into a frequency domain value.

The second transformation unit 210 transforms pixel values of a second image, which is obtained by actually printing the first image using an inkjet head (not illustrated), into frequency-domain values, and outputs the transformed result to the cross power spectral density detector 220. The second transformation unit 210 transforms each pixel value of the second image into a frequency-domain value by using Fast Fourier Transform. Each pixel value of the actually output second image is read using an image sensor (not illustrated). As illustrated in FIG. 5, the second transformation unit 210 transforms the value b of a pixel (m, n) of the second image into a frequency-domain value B(u, v). In the same way, the second transformation unit 210 transforms the pixel values read using the image sensor into frequency-domain values.

The cross power spectral density detector 220 detects 2D cross power spectral densities of the frequency-domain values of the first and second images, and outputs the detecting result to the third transformation unit 230. The cross power spectral density detector 220 detects 2D cross power spectral densities of the frequency-domain values of the first and second images, using Equation (1). For example, if a value received from the first transformation unit 200 is A(u, v) and a value received from the second transformation unit 210 is B(u, v), it is possible to detect a 2D cross power spectral density P(u, v)=A(u, v)B*(u, v) using Equation (1).

The third transformation unit 230 calculates a 2D cross correlation value by transforming each of the 2D cross power spectral densities detected by the 2D cross power spectral density detector 220 into a time domain value, and outputs the 2D cross correlation value to the error coordinates detector 240. The third transformation unit 230 transforms each of the 2D cross power spectral densities into a time domain value by using inverse Fast Fourier Transform. For example, if the 2Dcross power spectral density detected by the cross power spectral density detector 220 is P(u, v), the third transformation unit 230 performs inverse Fast Fourier Transform on the 2Dcross power spectral density P(u, v), and outputs a 2D cross correlation values p(m, n) that are a time domain value.

The error coordinates detector 240 detects from each of the time-domain cross correlation values error coordinates that represent the distances between the print dots of the second image and the first image, and outputs the detecting result to the coordinates compensation unit 250.

In particular, the error coordinates detector 240 detects error coordinates by subtracting the coordinates of a center pixel of the first image from the coordinates of a pixel having a maximum value of the time-domain cross correlation values. As illustrated in FIG. 3, if the coordinates of the pixel having the maximum value of the time-domain cross correlation values are (80, 70), error coordinates (Dx, Dy)=(30, 20) may be detected by subtracting the coordinates (50, 50) of the center pixel from the coordinates (80, 70).

The coordinates compensation unit 250 performs coordinates compensation in order to move the image sensor to the center of each of print dots sprayed from the inkjet head, using the detected error coordinates. The image sensor moves in order to sense print dots that are sprayed from the inkjet head and printed on a print medium after exchange of inkjet heads. In this case, in order to move the image sensor exactly to the center of each of the printed print dots, a precise compensation value for movement of the image sensor is obtained by subtracting the above error coordinates (Dx, Dy) from previous coordinates that were set for movement of the image sensor.

According to the various embodiments, in a method and apparatus to detect a print location error using print dots, it is possible to perform coordinates compensation by detecting errors between ideal print dots and actually printed print dots so that an image sensor can move exactly to print dots in order to sense print dots sprayed from an inkjet head that is newly exchanged in an image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of detecting a print location error using print dots, the method comprising:

transforming values of pixels of a first image into frequency domains, where a plurality of print dots are arranged at predetermined intervals in the first image;

transforming values of pixels of a second image, where the second image is obtained by actually printing the first image using an inkjet head, into frequency domains;

detecting 2D (2-dimensional) cross power spectral densities of the frequency-domain values of the first and second images;

calculating 2D cross correlation values by transforming the 2D cross power spectral densities into the time domain; and detecting error coordinates representing the distances between the print dots of the second image and the first image from the time-domain 2D cross correlation values.

2. The method of claim 1, further comprising:

performing coordinates compensation to move an image sensor to the center of each of the print dots sprayed from the inkjet head, using the detected error coordinates.

3. The method of claim 1, wherein the values of the pixels of the first and second images are transformed into frequency domains by using Fast Fourier Transform.

4. The method of claim 1, wherein the 2D cross power spectral densities are calculated by:

$$P(u, v)=A(u, v)B^*(u, v)$$

wherein A (u, v ) denotes the pixel values of the first image that are transformed into frequency domains, B*(u, v) denotes conjugate complex numbers of the pixel values of the second image that are transformed into frequency domains, and P(u, v) denotes 2D cross power spectral densities of the first and second images.

5. The method of claim 1, wherein the 2D cross power spectral densities are transformed into time domains using inverse Fast Fourier Transform.

6. The method of claim 1, wherein the error coordinates are detected by subtracting the coordinates of a center pixel of the first image from the coordinates of a pixel having a maximum value of the cross correlation values which are time-domain values.

7. A non-transitory computer readable medium having recorded thereon a program to execute a method of detecting a print location error using print dots, the method comprising:

transforming values of pixels of a first image into frequency domains, where a plurality of print dots are arranged in the first image at predetermined intervals;

transforming values of pixels of a second image, where the second image is obtained by actually printing the first image using an inkjet head;

detecting 2D (2-dimensional) cross power spectral densities of the frequency-domain values of the first and second images;

calculating 2D cross correlation values by transforming the 2D cross power spectral densities into the time domain; and detecting error coordinates representing the distances between the print dots of the second image and the first image from the time-domain 2D cross correlation values.

8. An apparatus to detect a print location error using print dots, the apparatus comprising:

a first transformation unit to transform values of pixels of a first image into frequency domains, where a plurality of print dots are arranged at predetermined intervals in the first image;

a second transformation unit to transform values of pixels of a second image into frequency domains, where the second image is obtained by actually printing the first image using an inkjet head;

a cross power spectral density detector to detect 2D (2-dimensional) cross power spectral densities of the frequency-domain values of the first and second images;

a third transformation unit to calculate 2D cross correlation values by transforming the 2D cross power spectral densities into time domains; and an error coordinates detector to detect error coordinates representing the distances between the print dots of the second image and the first image from the time-domain 2D cross correlation values,

9. The apparatus of claim 8, further comprising:

a coordinates compensation unit to perform coordinates compensation in order to move an image sensor to the center of each print dot sprayed from the inkjet head, using the error coordinates.

10. The apparatus of claim 8, wherein the first transformation unit and the second transformation unit transform their pixel values into frequency domains using Fast Fourier Transform.

11. The apparatus of claim 8, wherein the cross power spectral density detector detects 2D cross power spectral densities of the frequency-domain values of the first and second images using the following:

$$P(u, v)=A(u, v)B^*(u, v)$$

wherein A(u, v) denotes the pixel values of the first image that are transformed into frequency domains, B*(u, v) denotes conjugate complex numbers of the pixel values of the second image that are transformed into frequency domains, and P(u, v) denotes 2D cross power spectral densities of the first and second images.

12. The apparatus of claim 8, wherein the third transformation unit transforms the 2D cross power spectral densities into time domains using inverse Fast Fourier Transform,

13. The apparatus of claim 8, wherein the error coordinates detector detects the error coordinates by subtracting the coordinates of a center pixel of the first image from the coordinates of a pixel having a maximum value of the cross correlation values which are time-domain values.

14. A method of detecting a print location error using print dots, the method comprising:

transforming values of pixels of a first image into frequency domains, where a plurality of print dots are arranged at predetermined intervals in the first image;

transforming values of pixels of a second image, where the second image is obtained by actually printing the first image using an inkjet head, into frequency domains;

obtaining time-domain 2D (2-dimensial) cross correlation values from the frequency-domain values of the first and second images; and detecting error coordinates representing the distances between the print dots of the second image and the first image from the time-domain 2D cross correlation values.

15. An apparatus to detect a print location error using print dots, the apparatus comprising:

a first transformation unit to transform values of pixels of a first image into frequency domains, where a plurality of print dots are arranged at predetermined intervals in the first image;

a second transformation unit to transform values of pixels of a second image into frequency domains, where the second image is obtained by actually printing the first image using an inkjet head;

a cross power spectral density detector to detect 2D (2-dimensional) cross power spectral densities of the frequency-domain values of the first and second images;

a third transformation unit to obtain time-domain 2D cross correlation values from the frequency-domain values of the first and second images; and an error coordinates detector to detect error coordinates representing the distances between the print dots of the second image and the first image from the time-domain 2D cross correlation values.

* * * * *